US007562703B2

(12) United States Patent
Palmer et al.

(10) Patent No.: US 7,562,703 B2
(45) Date of Patent: Jul. 21, 2009

(54) ANNULAR FLOW SHIFTING DEVICE

(75) Inventors: Larry T. Palmer, Spring, TX (US); Gregory L. Hern, Huffman, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 147 days.

(21) Appl. No.: 11/497,992

(22) Filed: Aug. 2, 2006

(65) Prior Publication Data

US 2008/0029263 A1 Feb. 7, 2008

(51) Int. Cl.
*E21B 31/08* (2006.01)

(52) U.S. Cl. ..... 166/99; 166/205

(58) Field of Classification Search ..... 166/99, 166/205, 173

See application file for complete search history.

(56) References Cited

U.S. PATENT DOCUMENTS

| | | | | |
|---|---|---|---|---|
| 3,827,492 | A * | 8/1974 | Hammon et al. | 166/173 |
| 6,401,813 | B1 * | 6/2002 | Carmichael et al. | 166/173 |
| 6,607,031 | B2 | 8/2003 | Lynde et al. | |
| 7,322,408 | B2 * | 1/2008 | Howlett | 166/194 |

OTHER PUBLICATIONS

Bird, A.F., et al., "Intelligent Scraping Experience Using Ultrasonics in Two 60"/56" Dual Diameter 100 km. Seawater Transmission Pipelines in Saudi Arabia", SPE 29844, 1993, 19-32.

McClatchie, D.W., et al., "The Removal of Hard Scales From Geothermal Wells: California Case Histories", SPE 60723, 2000, 1-7.

Saasen, A., et al., "Well Cleaning Performance", IADC/SPE 87204, 2004, 1-7.

Fleming, A.J.A., et al., Wellbore Cleanup Best Practices: A North Sea Operator's Experience, SPE/IADC 101967, 2006, 1-8.

* cited by examiner

*Primary Examiner*—William P Neuder
(74) *Attorney, Agent, or Firm*—Steve Rosenblatt

(57) ABSTRACT

A wellbore cleanup tool collects debris when moved in one direction downhole. A flow diverter is extended for such flow diversion when debris is collected. When running the tool in the opposite direction in the wellbore, the flow diverter is in whole or in part articulated to retract so as to reduce resistance to fluid that passes around the outside of the tool. A segmented diverter can have fixed and movable components that are guided. The movable components can become longitudinally offset from the fixed components for movement in the direction where maximum flow bypass around the outside of the tool is desired. In an alternative embodiment, the diverter segments can all be movable on an inclined track to retract against a bias force for fluid bias with movement of the tool in the opposite direction allowing the bias to push the segments on the inclined track for diversion of debris laden fluid into a capture volume in the tool.

19 Claims, 3 Drawing Sheets

ANNULAR FLOW SHIFTING DEVICE

FIELD OF THE INVENTION

The field of this invention is wellbore cleanup tools and more particularly to flow diverting devices that direct well fluids into the tool for cleanup.

BACKGROUND OF THE INVENTION

Wellbore cleanup tools typically have a mandrel with a screen around it so as to define an annular space in between for accumulation of debris collected from the wellbore. Typically, some fluid diversion device is supported from the mandrel so that in at least one direction of movement of the tool, there is flow into the annular space and through the screen leaving the debris trapped in the annular space. The flow diverter can be fixed or movable with a movable design illustrated in U.S. Pat. No. 6,607,031 where one or more cup seals are illustrated. Some diverters block the flow totally such as one or more stacked cup seals while other designs just severely impede flow around the outside of the tool when directing flow into the annular space.

Since the cleanup of well fluids with these tools principally occurs with movement in a singe direction, it is desirable to get the tool to move at maximum speed in the opposite direction where no or very little capturing of debris actually occurs. The problem occurs with diversion devices that maintain wellbore wall contact in both directions, such as cup seals. For example, if the tool is designed to direct well fluids into the annulus behind the screen when being pulled out of the hole, when the tool is run into the hole, the cup seals still resist fluid movement past them even though they are deflected from the wellbore wall. When this happens, the speed with which the tool can be run into the wellbore is reduced or a risk develops of pressurizing the formation when running in the tool. This can occur when the insertion speed displaces fluid at a faster rate than fluid can bypass the cup seals. Building pressure on the formation can reduce its productivity while slowing the tool speed creates needless expense in operating expenses for surface personnel.

What is needed is a solution that allows delivery of the tool without speed restrictions while when the movement is reversed proper diversion of debris laden fluid into the annular space between the mandrel and the screen regardless of the design of the flow diverter. Several solutions are explored to this problem that focus on simple construction that will stand up to the downhole environment. These and other aspects of the present invention will be more clear to those skilled in the art from a review of the detailed description of the preferred embodiment and the associated drawings with the claims spelling out the full scope of the invention.

SUMMARY OF THE INVENTION

A wellbore cleanup tool collects debris when moved in one direction downhole. A flow diverter is extended for such flow diversion when debris is collected. When running the tool in the opposite direction in the wellbore, the flow diverter is in whole or in part articulated to retract so as to reduce resistance to fluid that passes around the outside of the tool. A segmented diverter can have fixed and movable components that are guided. The movable components can become longitudinally offset from the fixed components for movement in the direction where maximum flow bypass around the outside of the tool is desired. In an alternative embodiment, the diverter segments can all be movable on an inclined track to retract against a bias force for fluid bias with movement of the tool in the opposite direction allowing the bias to push the segments on the inclined track for diversion of debris laden fluid into a capture volume in the tool.

DETAILED DESCRIPTION OF THE DRAWINGS

DETAILED DESCRIPTION OF THE PREFERRED EMBODIMENT

Figure 1:
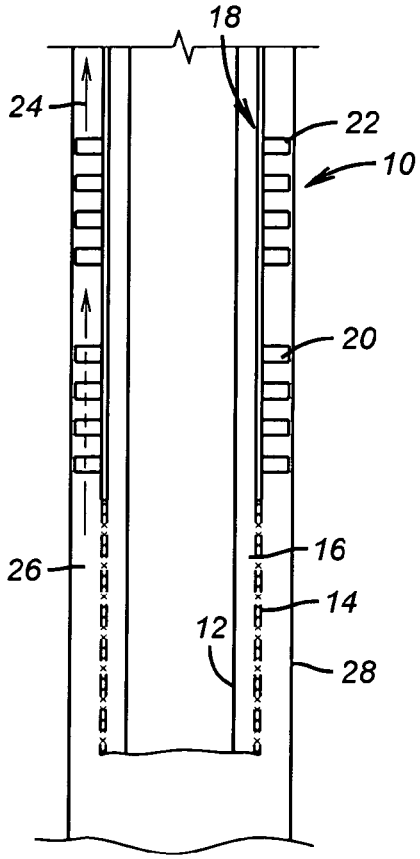
FIG. 1 shows an embodiment of the tool being run into the well with the flow diverters offset from each other.
Figure 2:
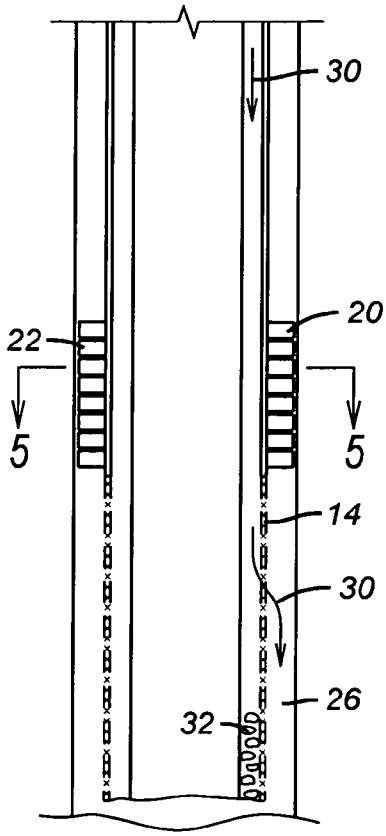
FIG. 2 is the view of FIG. 1 with the tool moving in the opposite direction to collect debris and the diverter segments abutting.
Figure 5:
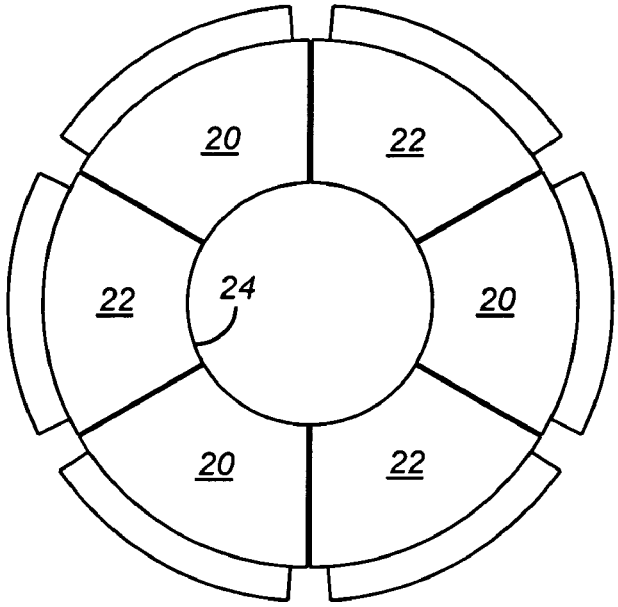
FIG. 5 is a section view through lines 5-5 of FIG. 2.
Figure 6:
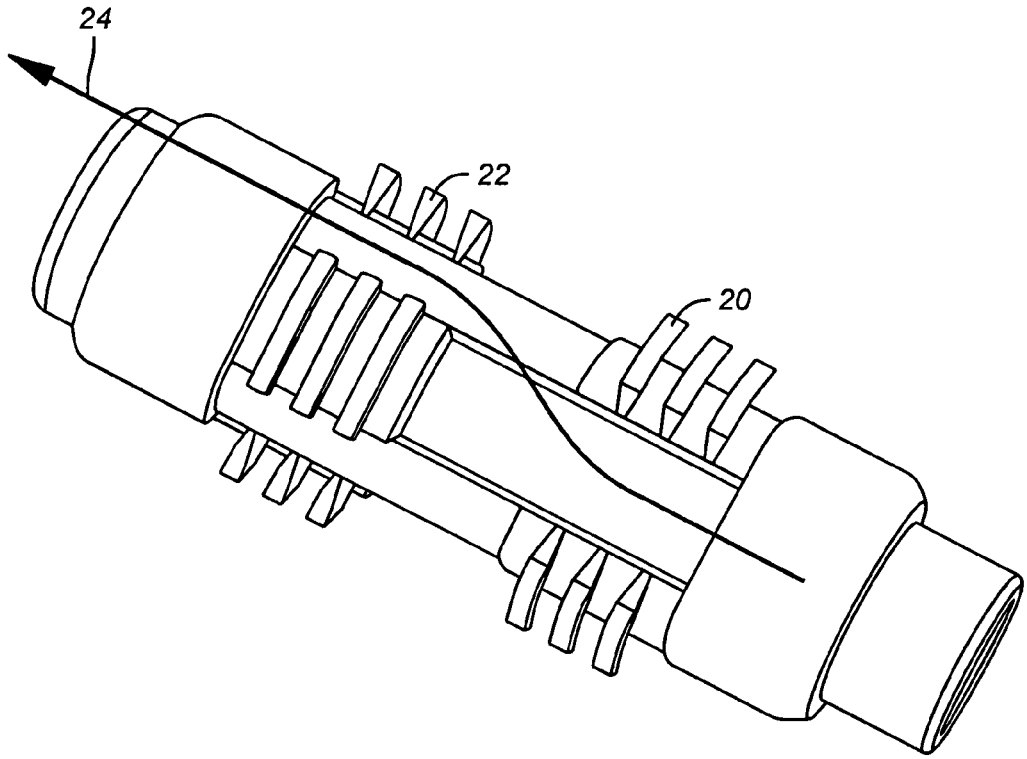
FIG. 6 is a perspective view of the tool in the position of FIG. 1.

FIG. 1 is a schematic view of a wellbore cleanup tool 10 that has a mandrel 12 surrounded by a screen 14 to define an annular space 16 between them for the purpose of accumulation of capture debris. A diverter assembly 18 is preferably made of segments 20 and 22 that circumferentially alternate on a support sleeve 24 as shown in FIG. 5. One group of the segments such as 20 can be rigidly mounted to sleeve 24 while the other group 22 can be slidably mounted for relative axial movement to an axially aligned position in FIG. 2 and an axially misaligned position in FIG. 1. When running into the hole the group 22 components are pushed uphole with respect to the mandrel 12 that is being run downhole. As a result the segments 22 are pushed on their guides to go axially uphole as the fluid represented by arrow 24 exerts an uphole force due to the descending mandrel 12. Fluid flow 24 moves around the outside of the tool 10 in the annular space 26 by coursing through the circumferential gaps between stationary segments 20 formed by the uphole displacement of the segments 22. After clearing past the segments 20 the fluid stream 24 simply makes a slight dog leg of a turn and goes between the circumferential gaps between displaced segments 22 formed because the segments 20 are not movable axially with respect to the advancing mandrel 12 to the extent that such gap can close. FIG. 1 illustrates that the tool 10 can be run into the wellbore 28 at a rapid rate because well fluids can quickly get by around the tool 10 in the annulus 26 by following a path first between segments 20 that didn't move much or at all and then making the necessary turns to get between segment 22 that have shifted up with respect to mandrel 12 to open a flow path having reduced resistance and thereby allowing rapid movement of the tool 10 downhole without creating formation pressure below it. The perspective view of FIG. 6 also illustrates these concepts.

Figure 7:
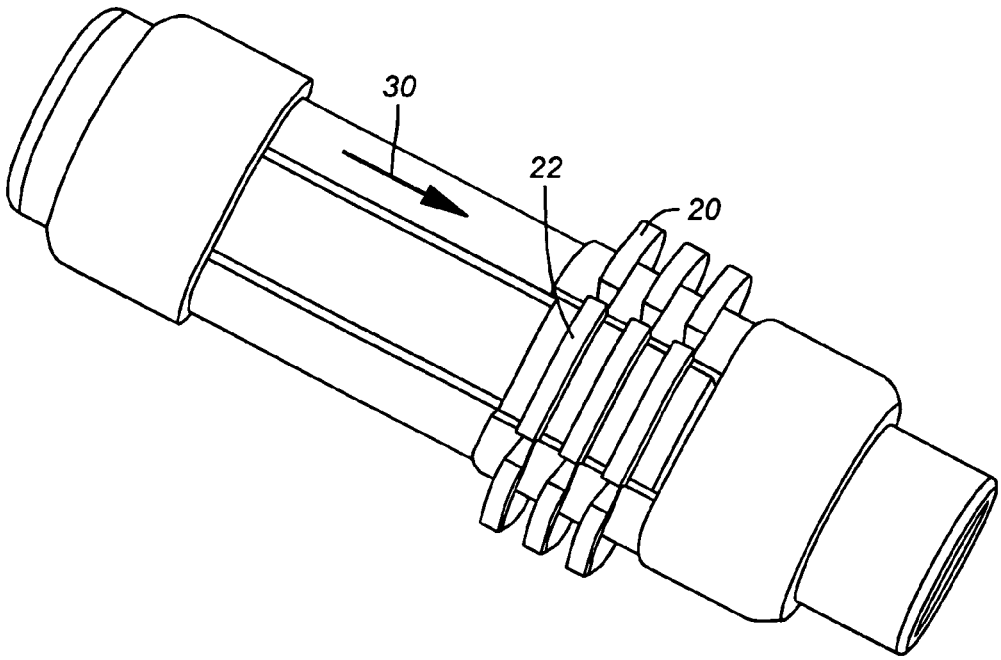
FIG. 7 is a perspective view of the tool in the position of FIG. 2.

When the tool 10 is moved in the opposite direction which is out of the wellbore 28 a flow in the direction of arrow 30 is induced and that pushes the segments 22 back into axial alignment with segments 20. This movement substantially closes off the annular space 26 around the tool 10 and directs fluid flow behind the segments 20 and 22 that are now axially aligned and into annulus 16 where the debris 32 is screened out and the remaining fluid passes through the screen 14 as the tool 10 is pulled from the wellbore 28. FIG. 7 illustrates these concepts.

Figure 3:
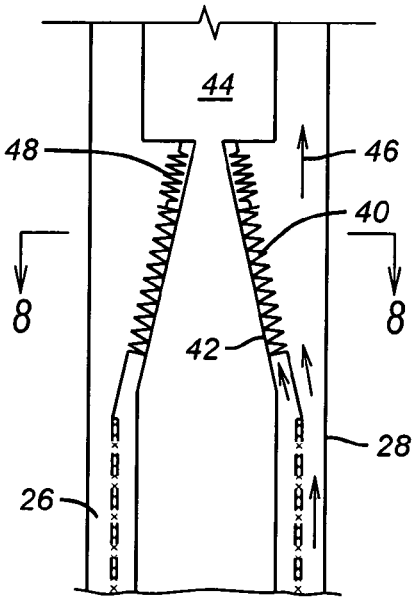
FIG. 3 is an alternative embodiment shown being run in with all segments retracted for fluid bypass.
Figure 4:
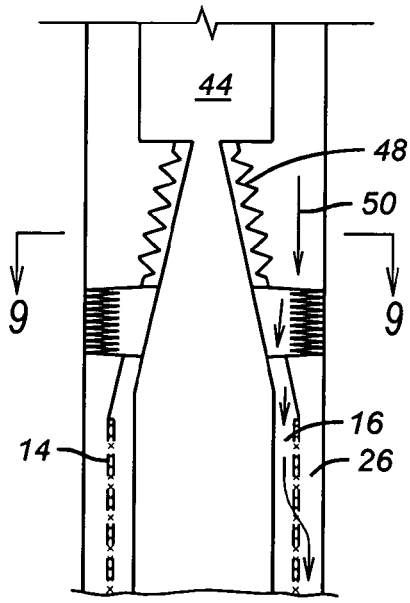
FIG. 4 is the view of FIG. 3 with the tool moving the opposite direction and the bias force pushing all the diverter segments against the wellbore wall for flow diversion through the screen.
Figure 8:
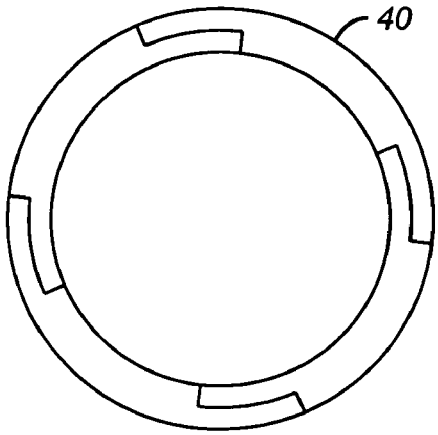
FIG. 8 is a section along lines 8-8 of FIG. 3 showing segments abutting and overlapping.
Figure 9:
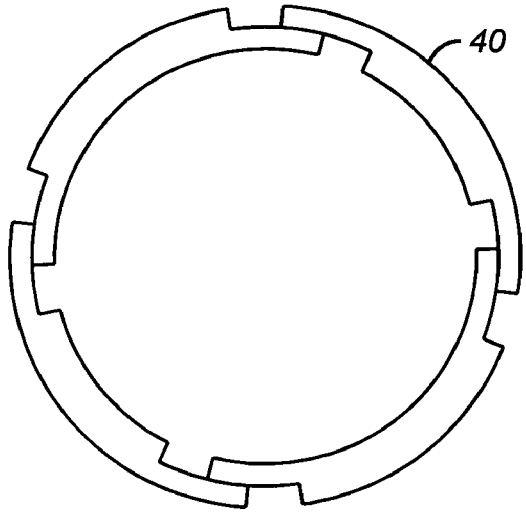
FIG. 9 is a section along lines 9-9 of FIG. 4 the segments of FIG. 8 still overlapping but at a larger diameter to block the annular space.

In the preferred embodiment, the segments 20 and 22 are sections of wire brush to get debris off the wellbore wall 28 as the tool 10 is pulled out of the hole. The segments can have gaps between the wire strands but in the aggregate they can fulfill the purpose of acting as a flow diverter when the segments are aligned. While in the preferred embodiment the segments are alternated between stationary and movably mounted, other patterns can be used between movable and stationary segment to allow or impede flow in the annulus 26. Other construction is envisioned for the segments apart from wires as long as the purpose of blocking and allowing annulus flow are accomplished. The segments can be made of solid blocks of material compatible with well operating conditions. Rather than segments, a unitary diverter is envisioned that can be retracted when the mandrel moves in one direction and extended when the movement direction is reversed. Segments that spread circumferentially rather than axially are also envisioned as illustrated in FIGS. 8 and 9. Segments may be on a scroll that rolls up when moved up an inline away from the wellbore 28 and rolls out to close off the annular space when advanced down that same incline. FIGS. 3 and 4 are schematic enough to illustrate this concept.

Segments can retract on a slope in a circumferentially abutting or/and overlapping position even while moving axially relatively to each other and then get pushed down that slope while still abutting and/or overlapping until circumferential contact with the wellbore wall is made. Thus despite a growth in diameter as the segments are advanced down a slope they still can substantially obstruct the annular space 26 when brought into contact with the wellbore 28. FIGS. 3 and 4 are schematic enough to illustrate this concept. In FIG. 3, the segments or overlapping scroll 40 is retracted on incline 42 as the mandrel 44 is brought down into the wellbore 28. This clears the annulus 26 for flow 46 to bypass the segments 40 while pushing against a bias 48 which can be a spring. When the direction of motion of the mandrel 44 is reversed, the spring 48 along with induced flow 50 push the segments or scroll 40 back down inclined surface 42 until the annular space 26 is closed and the flow 50 can be substantially redirected into annulus 16 and then through the screen 14.

The above description is illustrative of the preferred embodiment and many modifications may be made by those skilled in the art without departing from the invention whose scope is to be determined from the literal and equivalent scope of the claims below.

We claim:

1. A flow diverter for an annular space in a wellbore around a downhole tool, comprising:

a downhole tool having a longitudinal axis;

a base supporting a plurality of circumferentially alternating segments as viewed in a plane perpendicular to said longitudinal axis at least one entirely relatively axially movable with respect to another segment or with respect to said base to selectively provide different amounts of obstruction in said annular space when said base is moving in the wellbore.

2. The diverter of claim 1, wherein:

said relative movement is substantially aligned with said longitudinal axis.

3. The diverter of claim 1, wherein:

said segments comprise wire brushes.

4. A flow diverter for an annular space in a wellbore around a downhole tool, comprising:

a downhole tool having a longitudinal axis;

a base supporting a plurality of circumferentially alternating segments relatively movable with respect to each other to selectively provide different amounts of obstruction in said annular space;

said relative movement is substantially aligned with said longitudinal axis;

at least one segment is movably mounted to said base for axial alignment or misalignment with said other segments depending on the direction of movement of said downhole tool in the wellbore.

5. The diverter of claim 4, wherein:

at least one segment is fixedly mounted to said base.

6. A flow diverter for an annular space in a wellbore around a downhole tool, comprising:

a downhole tool having a longitudinal axis;

a base supporting a plurality of segments relatively movable with respect to each other to selectively provide different amounts of obstruction in said annular space;

said relative movement is substantially aligned with said longitudinal axis;

at least one segment is movably mounted to said base for axial alignment or misalignment with said other segments depending on the direction of movement of said downhole tool in the wellbore;

at least one segment is fixedly mounted to said base;

said fixed and movable segments alternate circumferentially around said base.

7. The diverter of claim 6, wherein:

said segments comprise wire brushes.

8. A flow diverter for an annular space in a wellbore around a downhole tool, comprising:

a downhole tool having a longitudinal axis;

a base supporting a plurality of segments relatively movable with respect to each other to selectively provide different amounts of obstruction in said annular space;

said downhole tool comprises a wellbore cleanup tool that farther comprises:

a mandrel;

a screen around said mandrel defining a debris annular space to retain debris from the wellbore;

wherein said base retaining said segments is spaced from said mandrel such that when said segments are positioned for most obstruction of the annular space around said wellbore cleanup tool, flow is channeled into said debris annular space.

9. The diverter of claim 8, wherein:

said segments are positioned for most obstruction when said wellbore cleanup tool is moved out of the wellbore.

10. The diverter of claim 9, wherein:

said relative movement is substantially aligned with said longitudinal axis.

11. The diverter of claim 10, wherein:

said base comprises a taper to allow said segments to substantially retract from the annular space around said wellbore cleanup tool for minimizing said obstruction of said annular space.

12. The diverter of claim 11, wherein:

said segments are biased toward obstructing the annular space around said wellbore cleanup tool.

13. A wellbore cleanup tool defining a surrounding annular space when run in the wellbore, comprising:

a mandrel;

a screen surrounding said mandrel and defining a debris retaining annular space in between;

a movably mounted flow diverter comprising circumferential segments which are movable between a first position where they are substantially out of said surrounding annular space and a second position where they are substantially obstructing said annular space.

14. The tool of claim 13, wherein:

said mandrel comprises a taper along which said diverter is movably mounted.

15. A wellbore cleanup tool defining a surrounding annular space when run in the wellbore, comprising:

a mandrel;

a screen surrounding said mandrel and defining a debris retaining annular space in between;

a movably mounted flow diverter movable between a first position where it is substantially out of said surrounding annular space and a second position where it is substantially obstructing said annular space;

said mandrel comprises a taper along which said diverter is movably mounted;

a biasing member to urge said diverter into the surrounding annular space.

16. The tool of claim 15, wherein:

said diverter comprises overlapping segments.

17. The tool of claim 15, wherein:

said diverter comprises a scroll.

18. The tool of claim 15, wherein:

said diverter comprises abutting segments in at least one position of said diverter.

19. The tool of claim 15, wherein:

said diverter comprises a plurality of spaced wires extending from at least one base.

* * * * *